US006095501A

United States Patent [19]

Vatne

[11] Patent Number: 6,095,501

[45] Date of Patent: Aug. 1, 2000

[54] STRETCH COMPENSATION IN A HOISTING SYSTEM FOR A DERRICK

[75] Inventor: Per Vatne, Rabbersvik, Norway

[73] Assignee: Maritime Hydraulics AS, Kristiansand, Norway

[21] Appl. No.: 09/091,729

[22] PCT Filed: Dec. 23, 1996

[86] PCT No.: PCT/NO96/00310

§ 371 Date: Jun. 24, 1998

§ 102(e) Date: Jun. 24, 1998

[87] PCT Pub. No.: WO97/24507

PCT Pub. Date: Jul. 10, 1997

[30] Foreign Application Priority Data

Dec. 27, 1995 [NO] Norway ..... 955310

[51] Int. Cl.[7] ..... B66F 1/00

[52] U.S. Cl. ..... 254/385; 254/386; 254/387; 254/266

[58] Field of Search ..... 254/385, 386, 254/387, 266; 166/77.1, 77.51, 96.1; 405/195.1, 196; 175/162

[56] References Cited

U.S. PATENT DOCUMENTS

| | | | |
|---|---|---|---|
| 1,472,386 | 10/1923 | Cook . | |
| 1,700,587 | 1/1929 | Higbee . | |
| 3,960,360 | 6/1976 | Elliston | 254/386 X |
| 4,170,340 | 10/1979 | Mouton, Jr. | 254/386 |
| 4,341,373 | 7/1982 | Mouton, Jr. | 254/386 |
| 4,605,078 | 8/1986 | Bukovitz et al. | 175/162 |
| 4,767,100 | 8/1988 | Philpot | 254/386 |

*Primary Examiner*—Donald P. Walsh
*Assistant Examiner*—Minh-Chau Pham
*Attorney, Agent, or Firm*—Pillsbury Madison & Sutro LLP

[57] ABSTRACT

An apparatus for a derrick, comprising two or more hydraulic piston-cylinder arrangements (10, 11) for raising and lowering a yoke (8) which travels on guide rails (7) in the derrick (1) itself, where two or more wire lines (13) are strung over sheaves (12) rotatably attached to the yoke. The wire lines (13) are attached at one end thereof to the top drive (9) and at the other end thereof are secured to an attachment point (14*a*, 14*b*) adjacent to a drill floor (2), said two or more wire lines being run in two sets (13*a*, 13*b*) of lines. The attachment points (14*a*, 14*b*) for each wire set are connected to a tension equalizer assembly to equalize differences in tension in the wire lines.

4 Claims, 5 Drawing Sheets

STRETCH COMPENSATION IN A HOISTING SYSTEM FOR A DERRICK

This application is the national phase of international application PCT/NO96/00310, filed Dec. 23, 1996 which designated the U.S.

FIELD OF THE INVENTION

The present invention relates to an apparatus for a derrick, comprising two or more hydraulic piston-cylinder arrangements for raising and lowering a yoke which travels on guide rails in the derrick itself, where two or more wire lines are strung over sheaves rotatably attached to the yoke, said wires being attached at one end thereof to the top drive and at the other end thereof being secured to an attachment point adjacent to a drill floor, said two or more wires being run in two sets of lines, the attachment points of which wire sets are spaced apart.

BACKGROUND OF THE INVENTION

A derrick structure which was developed in 1987 by the present inventor and which has shown great promise embodies the RamRig™ concept. Two hydraulic piston-cylinder arrangements are used in the derrick for raising and lowering the drill string. The cylinders operate between the drill floor and a yoke which travels on guide rails in the derrick itself The advantages of this concept are numerous, some of the most important being that it is possible to place the drill floor at a higher level than the platform floor, that a derrick may be constructed having a significantly lower air resistance, that a higher level of safety and longer lifetime are attained for the most expensive components of the derrick.

Since it is possible to position the drill floor higher than the platform floor, pipe handling is significantly simplified. There is no longer any need to arrange the pipe handling equipment at a high level in the derrick. All pipe handling equipment may be placed on the platform floor and the drill floor.

The object of the present invention is to solve important, practical problems in the realization of the RamRig™ concept.

BRIEF DESCRIPTION OF THE DRAWINGS

The invention will now be explained in greater detail with reference to the enclosed drawings, where.

DETAILED DESCRIPTION OF THE INVENTION

Figure 1:
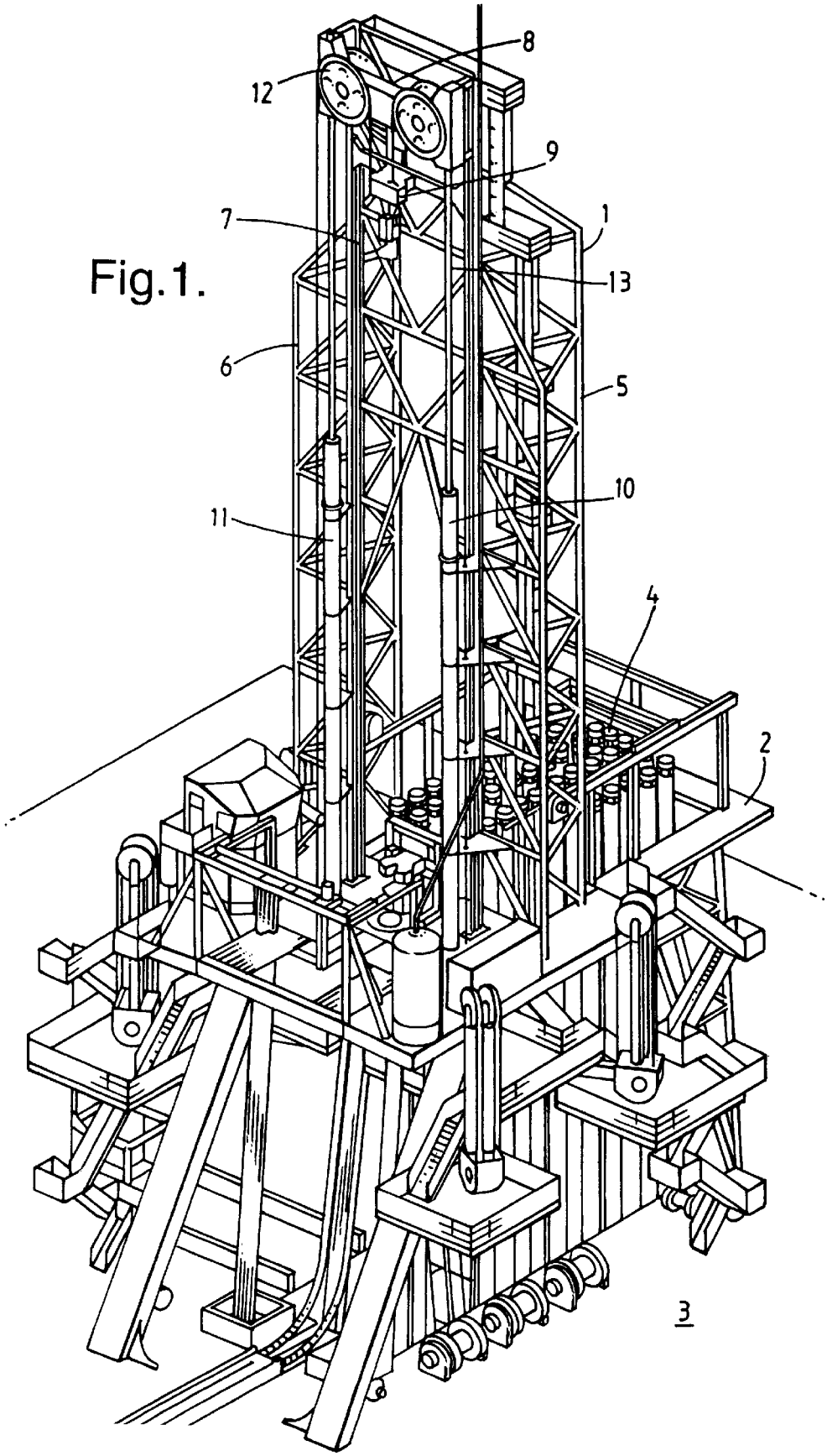
FIG. 1 shows a RamRig™ derrick in every essential detail.

FIG. 1 shows a derrick 1 positioned on a drill floor 2. The drill floor is arranged at a higher level than the platform floor

3, enabling the pipe handling equipment 4 to be placed mainly between the platform floor 3 and the drill floor 2. Derrick 1 is substantially gantry-shaped, having gantry legs 5, 6. Guide rails 7 for a yoke 8 and a top drive 9 run along each gantry leg 5, 6. Hydraulic piston-cylinder arrangements 10, 11 are positioned so as to extend along each gantry leg 5, 6, and operate between drill floor 2 and yoke 8, for moving yoke 8 vertically along guide rails 7.

The yoke 8 is provided with a plurality of sheaves 12, preferably four, for running the wire lines 13. Wire lines 13 extend from drill floor 2 along each gantry leg 5, 6, over sheaves 12 and down to top drive 9. By retracting and extending the piston-cylinder arrangement 10, 11, it is thereby possible to raise and lower top drive 9.

Figure 2:
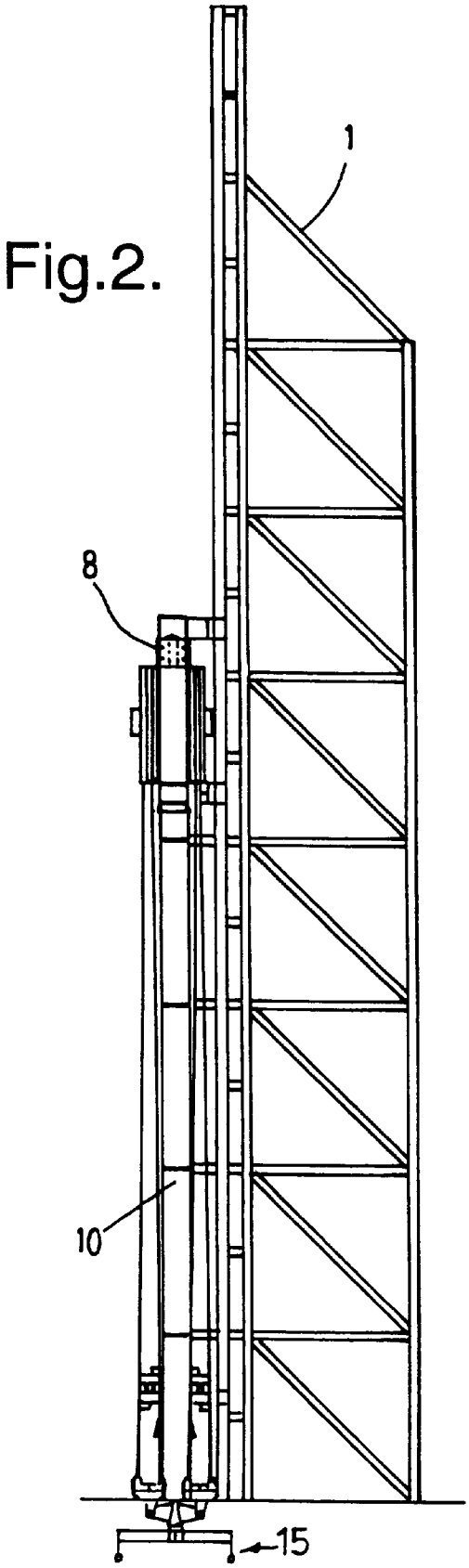
FIG. 2 shows the derrick schematically, viewed from the side.
Figure 3:
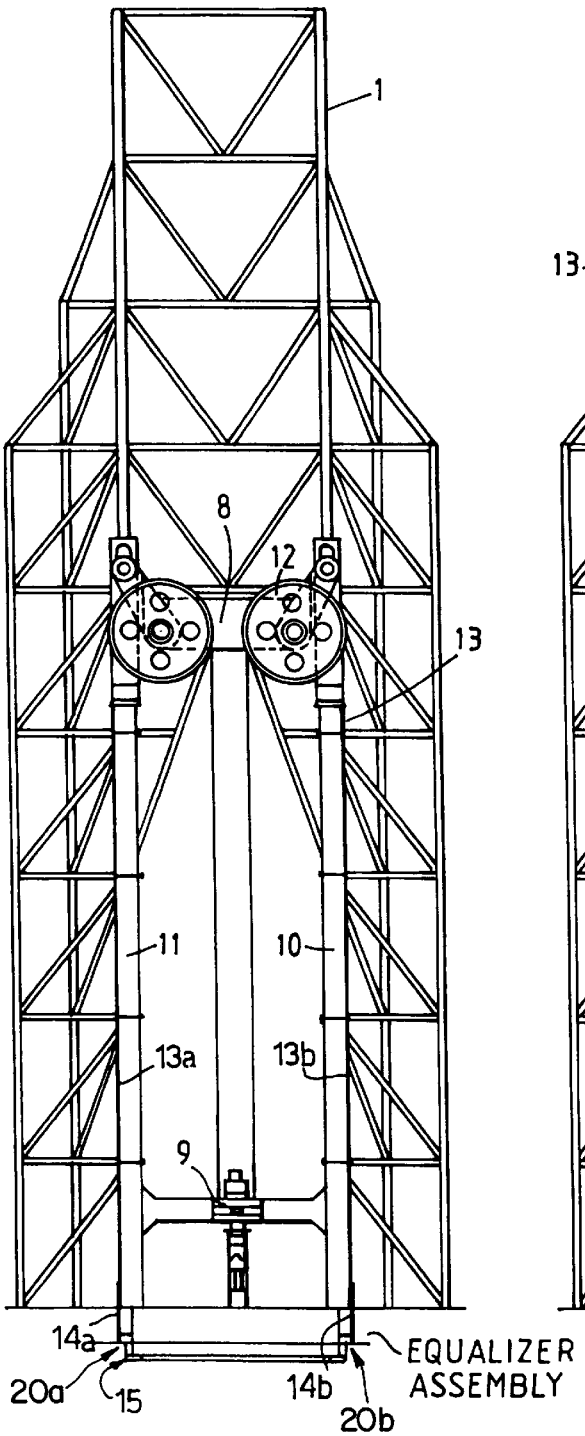
FIG. 3 shows the derrick schematically, viewed from the front, with the top drive in its lowermost position.
Figure 4:
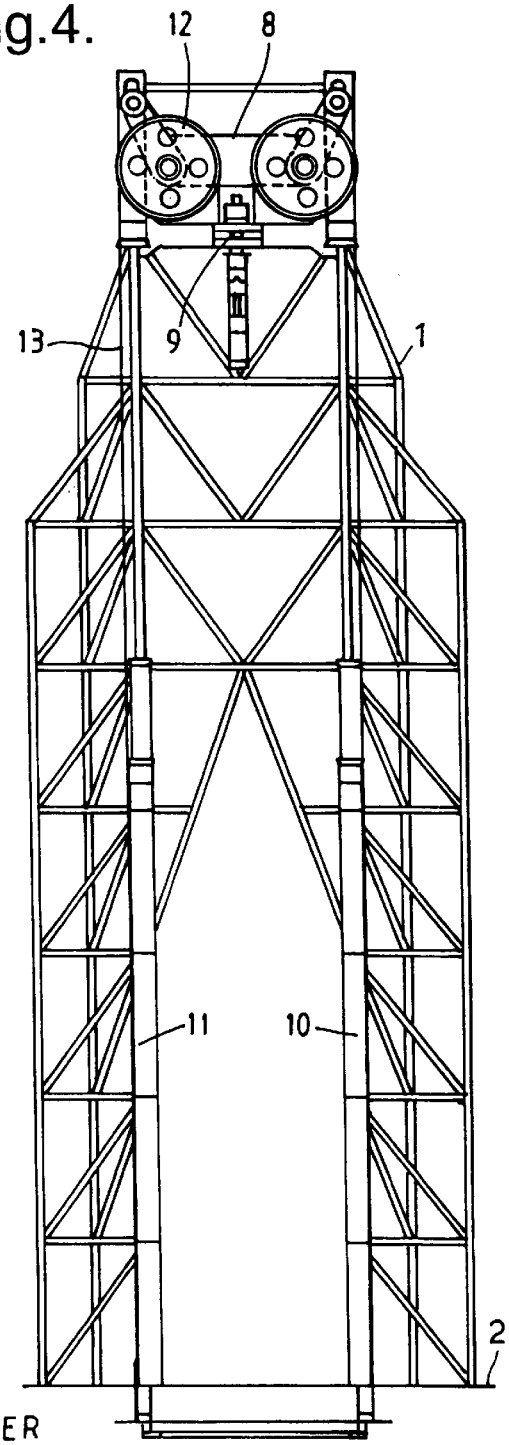
FIG. 4 shows the derrick schematically, viewed from the front, with the top drive in its uppermost position.

In FIGS. 2, 3 and 4 the function of the hoisting system is seen most clearly. In FIGS. 2 and 3 the piston-cylinder arrangement 10, 11 is shown in a completely retracted state. Top drive 9 is then at its lowermost position, quite close to the drill floor. Yoke 8 is at the upper end of the piston-cylinder arrangement.

When the pistons in the piston-cylinder arrangement are extended, yoke 8 is lifted along guide rails 7 up to the top of derrick 1. The top drive is then lifted, as a result of the transmission generated as wire lines 13 are run over sheaves 12, from its position adjacent drill floor 2 to a position directly below yoke 8. The height to which top drive 9 is hoisted is thus the double of that to which yoke 8 is lifted.

There may, for example, be as many as eight wire lines 13 arranged in the hoisting apparatus described above, with the wire lines being strung two by two in their respective tracks over the same sheave 12. Four sheaves are arranged in pairs at each end of yoke 8. Wire lines 13 are thus arranged in two sets 13*a* and 13*b*, extending from attachment points 14*a* and 14*b* at drill floor 2, over sheaves 12 and down to top drive 9. Attachment points 14*a* and 14*b* are spaced apart horizontally by a distance corresponding approximately to the length of yoke 8.

Wire lines 13 will seldom be of exactly the same length or exhibit exactly the same elasticity module. Therefore, as a rule, there will be different tensions in the wire lines 13. This can result in increased strain on some of the individual wires, which in turn increases the wear and tear thereof.

To help alleviate this problem, there is proposed according to the invention the provision of a tension equalizer assembly 15 at the point of attachment 14 of wire lines 13 adjacent drill floor 2.

Figure 5:
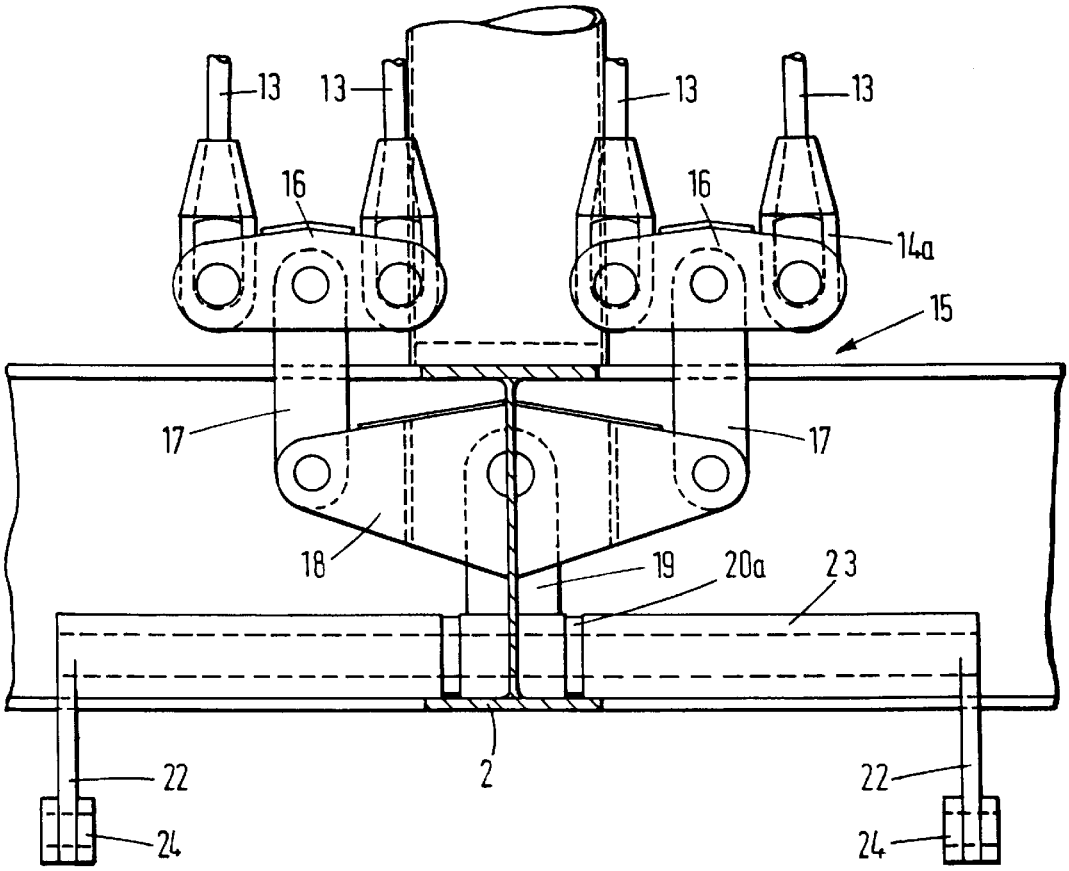
FIG. 5 shows the tension equalizer assembly seen from the side.
Figure 6:
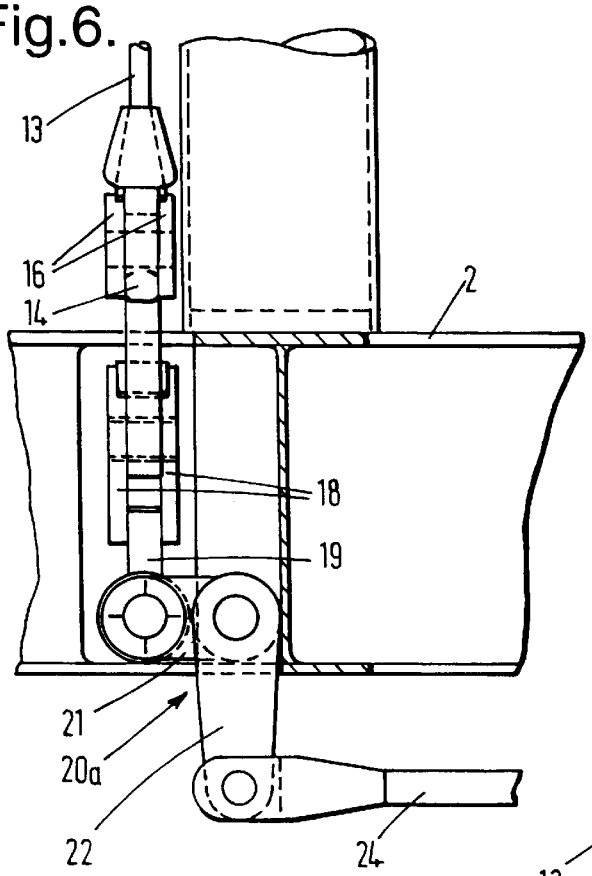
FIG. 6 shows a portion of the tension equalizer assembly, seen from the front.
Figure 7:
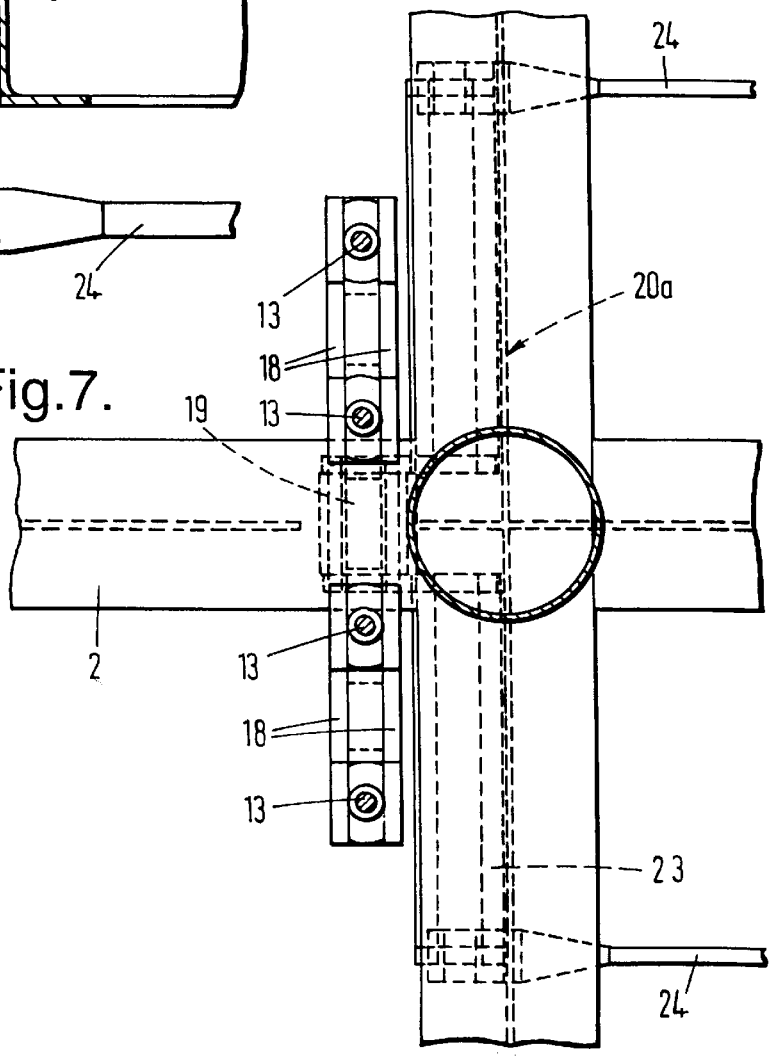
FIG. 7 shows a portion of the tension equalizer assembly seen from above.

The tension equalizer assembly 15 is seen most clearly in FIGS. 5–7. In FIG. 5 we see that wire lines 13 in each wire set are rotatably attached in pairs to their respective ends of a wire pair balance arm 16 for each pair of wires. Each wire pair balance arm 16 is pivotably attached, via its respective wire pair bar 17 extending downward from the center of wire pair balsam arm 16, to one end of a wire set balance arm 18. Wire set balance arm 18 is in turn pivotably attached, via a wire set bar 19 extending downward from the center of wire set balance arm 18, to an angle lever 20*a*, which is best seen in FIG. 6.

Angle lever 20*a* consists of a horizontal arm 21, extending in the direction of the opposing wire set 13*b*, and two vertical downward-oriented arms 22. Arms 22 are firmly connected to arm 21 via two horizontal bars 23, which extend perpendicularly to arm 21, and arms 22 are firmly connected to arm 21 at the end thereof opposite to the attachment point for wire set bar 19, and to arms 22 at the uppermost end thereof. Angle lever 20*a* is pivotably mounted in drill floor 2 about bar 23. The lowermost ends of arms 22 are rotatably connected to their respective balance bar 24. Balance bars 24 extend horizontally in a direction toward the opposing wire set 13*b*. Here, balance bars 24 are rotabably connected to an angle lever 20*b* corresponding to angle lever 20*a*. In other respects the tension equalizer assembly 15 has an identical form at attachment point 14*b* for wire set 13*b*.

If, for example, one of the wires 13 in wire set 13*a* were to be slightly shorter than the other wires 13, this would pull on wire pair balance arm 16, causing it to assume a tilted position, with the end to which the shortest wire is attached being furthest up. If both of the wires 13 in this pair of wire lines were to be shorter than the wires attached to the other wire pair balance arm 16 in wire set 13*a*, then wire set balance arm 18 would also assume a tilted position.

If the wire lines in wire set 13*a* together exert a greater tension than the wire lines in wire set 13*b*, then the arm 21 of angle lever 20*a* would be drawn upward causing the arms 22 and therewith also balance bars 24 to be drawn in a direction away from the other wire set 13*b*. The opposite angle lever 20*b* would thereby also be turned about its attachment point in drill floor 2, thus exerting tension on wire set 13*b*, which tension is further equalized between the individual wire lines in wire set 13*b* in the same manner as for wire set 13*a*.

With the aid of the above described wire tension equalizer assembly 15, it is possible to avoid overloading and/or premature wear and tear on individual wires. It is also possible to reduce the demands for tolerance with respect to, for example, the length of the wires. Furthermore, it is possible to utilize a plurality of thinner and more flexible wires instead of a few heavier wires, inasmuch as the tension may be uniformly distributed among all of the wires.

Although, in the above, there is described a tension equalizer assembly comprising a plurality of balance arms, it is clear that with the use of fewer wires, there would be no need for as many arms. When using only one wire line on each side, for example, this one wire could, of course, be connected directly to arm 21.

What is claimed is:

1. An apparatus for a derrick, comprising two or more hydraulic piston-cylinder arrangements for raising and lowering a yoke which travels on guide rails in the derrick itself, where two or more wire lines are strung over sheaves rotatably attached to the yoke, which wire lines are attached at one end thereof to a top drive and at the other thereof are secured to an attachment point adjacent to a drill floor, said two or more wire lines being run in two sets of lines, the attachment points for which are spaced apart, wherein the attachment point for each set of wire lines is connected to its respective end of at least one balance bar joined to the drill floor, which bar is movable in order to equalize different tensions in the wire lines.

2. The apparatus in accordance with claim 1, wherein the wire lines are connected to the balance bar via an angle lever for each wire set, which angle lever is pivotably mounted in the drill floor, wherein the wires are attached to one arm of the angle level and wherein the balance bar is attached to the other arm of the angle lever.

3. The apparatus in accordance with claim 2, wherein the wire set is connected to the angle lever via a wire set balance arm, said wires being attached to the ends of the wire set balance arm, while the angle lever is attached to the center of the wire set balance arm.

4. The apparatus in accordance with claim 3, wherein the wire set is connected to the wire set balance arm via two wire pair balance arms, said wires being attached to the ends of the wire pair balance arms, whereas the wire set balance arm is attached to the center of the wire pair balance arms.

* * * * *